US011427954B2

(12) United States Patent
Park et al.

(10) Patent No.: US 11,427,954 B2
(45) Date of Patent: Aug. 30, 2022

(54) LAUNDRY TREATING APPARATUS

(71) Applicant: LG Electronics Inc., Seoul (KR)

(72) Inventors: Bio Park, Seoul (KR); Beomjun Kim, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 470 days.

(21) Appl. No.: 16/273,651

(22) Filed: Feb. 12, 2019

(65) Prior Publication Data

US 2019/0249355 A1 Aug. 15, 2019

(30) Foreign Application Priority Data

Feb. 12, 2018 (KR) ..... 10-2018-0017202

(51) Int. Cl.
*D06F 58/26* (2006.01)
*D06F 25/00* (2006.01)
(Continued)

(52) U.S. Cl.
CPC ..... *D06F 58/26* (2013.01); *D06F 25/00* (2013.01); *D06F 39/04* (2013.01); *D06F 58/02* (2013.01);
(Continued)

(58) Field of Classification Search
CPC ..... D06F 58/263
See application file for complete search history.

(56) References Cited

U.S. PATENT DOCUMENTS 4,181,846 A * 1/1980 Cunningham ..... H05B 6/108 219/619
5,042,171 A * 8/1991 Obata ..... D06F 58/24 34/604
(Continued)

FOREIGN PATENT DOCUMENTS

EP 1914339 4/2006
EP 2400052 12/2011
(Continued)

OTHER PUBLICATIONS

CN203801093—machine translation (Year: 2014).*
Extended European Search Report in European Application No. 19156575.3, dated Jun. 18, 2019, 8 pages.

*Primary Examiner* — Nathaniel Herzfeld
(74) *Attorney, Agent, or Firm* — Fish & Richardson P.C.

(57) ABSTRACT

A laundry treating apparatus include: a cabinet; a tub disposed in the cabinet; a drum rotatably disposed in the tub, and having a cylindrical portion formed of a ferromagnetic material and a rear wall portion for closing an open rear end of the cylindrical portion, wherein the cylindrical portion has a plurality of through-holes formed therein and allows laundry to be loaded thereinto through an opening portion formed on a front surface; an induction heater disposed in the tub and configured to heat the drum by inducing an eddy current in the cylindrical portion; a duct disposed on an outer side of the tub, having an inlet communicating with an open front surface of the cylindrical portion, and an outlet communicating with the tub through a side surface of the tub surrounding the cylindrical portion; and an air blower configured to suction air, discharged from the drum, into the inlet.

20 Claims, 10 Drawing Sheets

(51) Int. Cl.

| | |
|---|---|
| *D06F 39/04* | (2006.01) |
| *D06F 58/22* | (2006.01) |
| *D06F 58/24* | (2006.01) |
| *D06F 58/02* | (2006.01) |
| *D06F 103/08* | (2020.01) |
| *D06F 103/12* | (2020.01) |

(52) U.S. Cl.
CPC ..... *D06F 58/22* (2013.01); *D06F 58/24* (2013.01); *D06F 2103/08* (2020.02); *D06F 2103/12* (2020.02)

(56) References Cited

U.S. PATENT DOCUMENTS

| | | | | |
|---|---|---|---|---|
| 2003/0014880 | A1* | 1/2003 | Baurmann | D06F 58/22 34/595 |
| 2013/0031798 | A1* | 2/2013 | Bae | D06F 58/24 34/469 |
| 2013/0219734 | A1 | 8/2013 | Kim et al. | |
| 2014/0059881 | A1* | 3/2014 | Kim | D06F 29/005 34/493 |
| 2014/0109427 | A1* | 4/2014 | Kim | D06F 58/22 34/85 |
| 2014/0109435 | A1* | 4/2014 | Lee | F26B 21/086 34/468 |
| 2014/0208609 | A1* | 7/2014 | Han | D06F 58/22 34/549 |
| 2016/0115638 | A1* | 4/2016 | Kim | D06F 58/30 34/499 |
| 2016/0258107 | A1* | 9/2016 | Hake | D06F 58/206 |

FOREIGN PATENT DOCUMENTS

| | | |
|---|---|---|
| EP | 3246454 | 11/2017 |
| JP | 2004135998 | 5/2004 |
| KR | 1019940015064 | 7/1994 |
| KR | 1020150015706 | 2/2015 |
| KR | 1020160149852 | 12/2016 |
| WO | WO2016182346 | 11/2016 |

* cited by examiner

LAUNDRY TREATING APPARATUS

CROSS-REFERENCE TO RELATED APPLICATION

This application claims the priority benefit of Korean Patent Application No. 10-2018-0017202, filed on Feb. 12, 2018, in the Korean Intellectual Property Office, the disclosure of which is incorporated herein by reference.

TECHNICAL FIELD

The present disclosure relates to a laundry treating apparatus having an induction heater.

BACKGROUND

EP 3 276 071 A1 (hereinafter, referred to as a "Related Art") discloses a washing drying machine having a drum formed of a ferromagnetic material and an electric coil. The coil is positioned close to the drum, and thus, when high frequency current power is applied to the coil, an alternating magnetic field works on the drum, thereby inducing an eddy current and accordingly heating the drum.

The washing drying machine is provided with an air blower for blowing air into the drum. A drying operation is performed in a manner in which air transferred by the air blower is brought into contact with the drum to increase temperature and then the air is applied to laundry in the drum.

A structure of a flow path for guiding the air transferred by the air blower toward the drum influences not just dry performance and dry efficiency, but also a capacity of the drum (that is, a capacity of accommodating laundry). However, Related Art does not mention at all a structure of a flow path for guiding air transferred by the air blower.

SUMMARY

The first object of the present disclosure is to provide a laundry treating apparatus with an increased capacity of a drum by improving a flow path structure of circulating air into the drum in the laundry treating apparatus to which an induction heater is applied.

The second object of the present disclosure is to provide a laundry treating apparatus which enables a more amount of heat to be transferred to circulating dry air from a drum heated by an induction heater.

The third object of the present disclosure is to provide a laundry treating apparatus capable of cooling a heat dissipation portion of a heat exchanger and an induction heater with a shared cooling fan.

The fourth object of the present disclosure is to provide a laundry treating apparatus which enables water condensed in a duct to be discharged into a tub without making laundry in the drum wet.

The fifth object of the present disclosure is to provide a laundry treating apparatus which allows a user to easily replace a filter that is used to filter air to be introduced into the duct.

The sixth object of the present disclosure is to provide a hot air circulating step which enables heat generated by an induction heater to be optimally transferred into a drum.

Objects of the present disclosure should not be limited to the aforementioned objects and other unmentioned objects will be clearly understood by those skilled in the art from the following description.

In a laundry treating apparatus according to the present disclosure, a drum having at least one portion formed of a ferromagnetic material is rotatably installed in a tub, and an induction heater for heating the drum is disposed in the tub.

The drum is formed of a ferromagnetic material and has a cylindrical portion with a plurality of through-holes formed therein, and the cylindrical portion is heated by the induction heater. A duct for circulating air discharged from the drum is provided on an outer side of the tub, and an air blower for suctioning the air, discharged through an opening portion formed on a front surface of the cylindrical portion, into the duct is provided.

An outlet of the duct communicates with the tub through a side surface of the tub. The side surface of the tub is a portion surrounding of a circumference of the cylindrical portion of the drum. An opening portion is formed on the side surface such that air discharged through the outlet of the duct is introduced into the tub through the opening portion formed on the side surface.

The drum may further include a rear wall portion for closing an open rear end of the cylindrical portion.

The induction hater may induce an eddy current in the cylindrical portion. The induction heater may be disposed on the outer side of the tub.

There may be provided a lint filter for filtering lint included in the air introduced into the duct, and a heat exchanger for condensing moisture from the air in the duct. The air introduced into the duct may pass through the lint filter, the air blower, and the heat exchanger in order.

The heat exchanger may have a guide surface for guiding condensed water, formed as a result of the condensing of the moisture, the guide surface which is inclined downward toward a condensed water discharge port that communicates with the tub. A drain pipe connecting the condensed water discharge port and the tub may be further included.

The heat exchanger may further include a separator protruding from the guide surface, the condensed water discharge port may be disposed at an upstream side of the separator, and an air discharge port for discharging the air, guided on the guide surface along the duct, into the tub may be formed at a downstream side of the separator.

The separator may further include a surface convex toward an upstream side of an air flow guided along the duct.

The condensed water discharged through the condensed water discharge port may flow along an inner circumferential surface of the tub.

The heat exchanger may further include: a heat absorption portion disposed in the duct and configured to absorb heat from ambient air so as to evaporate a refrigerant flowing along a refrigerant pipe; and a heat dissipation portion disposed on an outer side of the duct and configured to transfer heat to the ambient air from the refrigerant, and the laundry treating apparatus may further include a cooling fan configured to blow air so as to cool the heat dissipation portion and the induction heater.

A laundry loading hole may be formed on a front surface of the cabinet. The tub may include: an opening formed on a front surface of the tub; a gasket formed of a soft material, and having a front end fixed to the front surface of the cabinet and a rear end fixed to the front surface of the tub such that a tubular-shaped passage extending from the laundry loading hole to a front end of the tub is formed; and a duct mount having a tubular shape protruding from an outer circumferential surface of the gasket, and allowing the front end of the duct to be inserted thereinto. The gasket may further include: an opening portion communicating with the duct mount on an inner circumferential surface that defines the passage; and a lint filter detachably inserted into the opening portion of the gasket to filter air to be introduced into the duct.

The induction heater may be disposed on an upper side of the tub.

The induction heater may include a coil formed by a wire that is spirally wound round on a single predetermined surface. The induction heater may include a heater cover for covering the coil, and the laundry treating apparatus may further include a ferromagnetic material interposed between the heater cover and the coil.

The induction heater may operate while the drum rotates, and The operation of the induction may be initiated while the drum rotates.

The laundry treating apparatus according to the present disclosure has an advantage in increasing a laundry accommodating capacity in that, because an outlet of a duct for guiding circulating air required to dry laundry communicates the tub through a side surface of the tub, the tub may be extended further to the rear, compared to a conventional structure in which the duct is connected to a rear surface of the tub, and accordingly even the drum installed in the tub may be extended further to the rear.

Second, an amount of air to leak between the rear wall portion of the drum and the tub is reduced from air discharged through the outlet of the duct, and therefore, an amount of air to come into contact with the cylindrical surface of the drum is increased relatively, thereby effectively transferring an amount of heat to circulating dry air from the cylindrical portion heated by the induction heater.

Third, as the heat dissipation portion (a heat dissipation surface for a thermoelectric module) serving to condense a refrigerant in the heat exchanger, which is provided to condense moisture from circulating air is disposed on an outer side of the duct, both the heat dissipation portion and the induction heater may be cooled with a shared cooling fan and therefore there is an advantage in reducing the number of components and simplifying the structure.

Fourth, condensed water formed in the duct by the heat exchanger is smoothly transferred along an inclined guide surface, and thus, there is no need for an additional active drain means.

Fifth, the lint filter is installed on the inner circumferential surface of the gasket, which is exposed when the door is opened, and thus, this structure allow a user to easily detach the lint filter to clean.

DETAILED DESCRIPTION

Hereinafter, an exemplary embodiment of the present disclosure will be described in detail with reference to the accompanying drawings. It is to be understood that exemplary embodiments described below are illustratively provided to facilitate understanding of the present disclosure, and the present disclosure may be variously modified and embodied other than the exemplary embodiments described herein. However, in describing the present disclosure, a detailed description of known functions and components incorporated herein will be omitted when it may make the subject matter of the present disclosure unclear. In addition, the accompanying drawings are not drawn to scale to facilitate understanding of the present disclosure, but the dimensions of some of the components may be exaggerated.

It will be understood that although the terms "first," "second," etc., may be used herein to describe various components, these components should not be limited by these terms. These terms are only used to distinguish one component from another component.

Some terms used herein may be provided merely to describe a specific embodiment without limiting the scope of another embodiment. In the description, the singular forms "a", "an" and "the" are intended to include the plural forms as well, unless the context clearly indicates otherwise. It will be understood that the terms "comprising", "including", "having" and variants thereof specify the presence of stated features, numbers, steps, operations, elements, components, and/or groups thereof, but do not preclude the presence or addition of one or more other features, numbers, steps, operations, elements, components, and/or groups thereof.

In the description, the word "module" or "unit" refers to a software component, a hardware component, or a combination thereof, which is capable of carrying out at least one function or operation. A plurality of modules or units may be integrated into at least one module and implemented using at least one processor except for those modules or units that need to be implemented in specific hardware.

Figure 1:
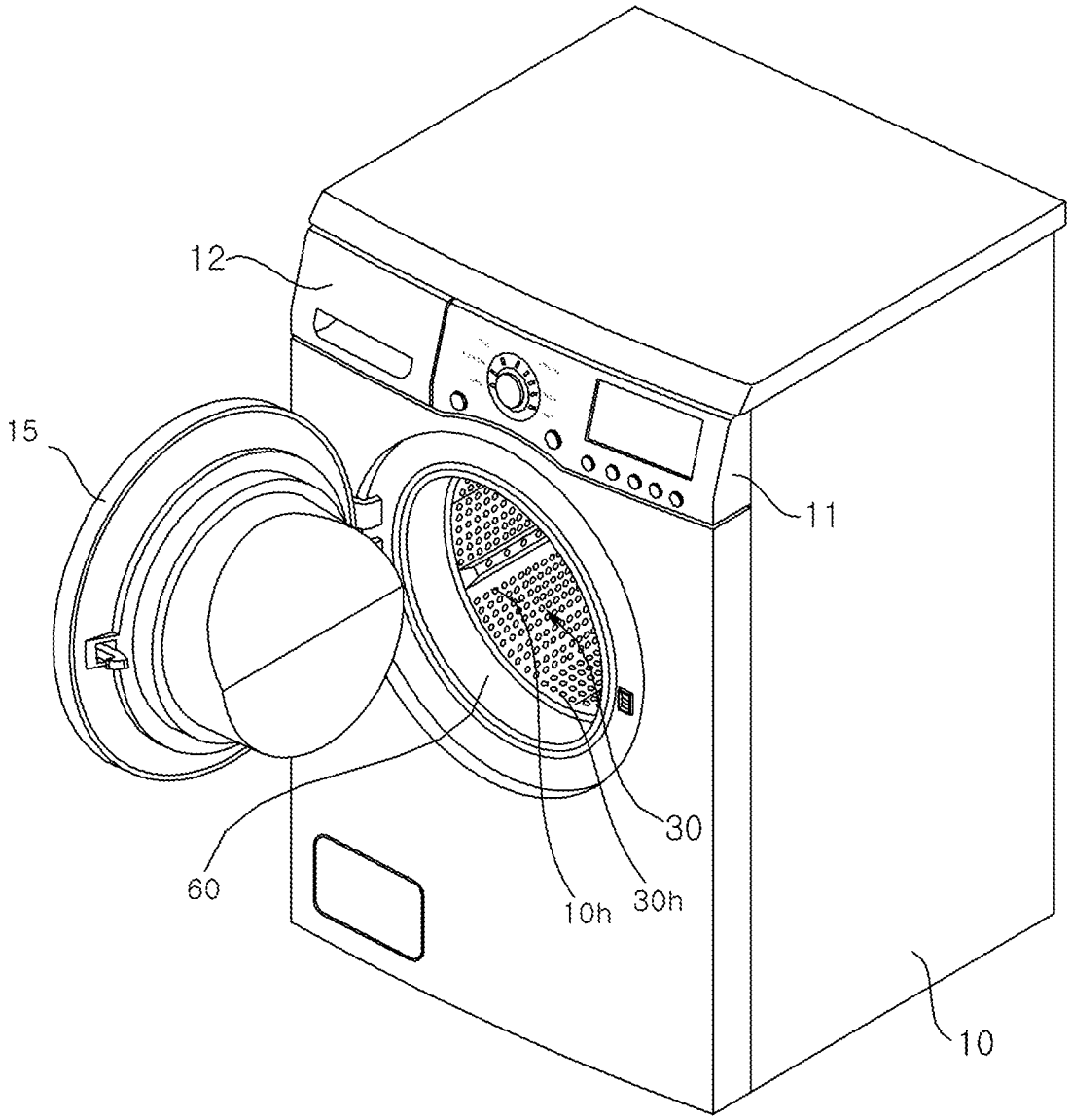
FIG. 1 is a perspective view illustrating an external appearance of a laundry treating apparatus according to the present disclosure.
Figure 2:
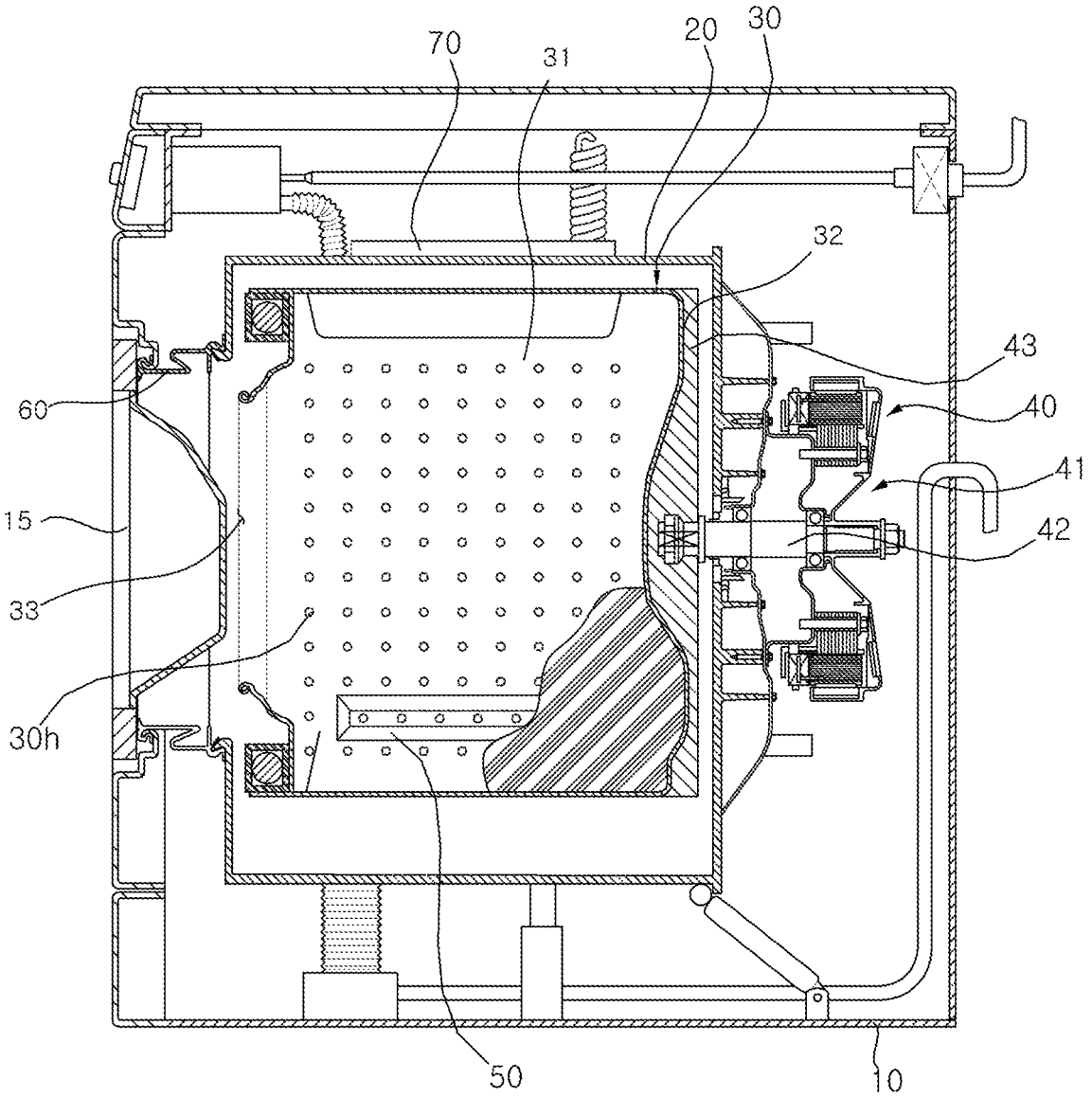
FIG. 2 is a cross-sectional view illustrating an interior of a laundry treating apparatus according to the present disclosure.
Figure 3:
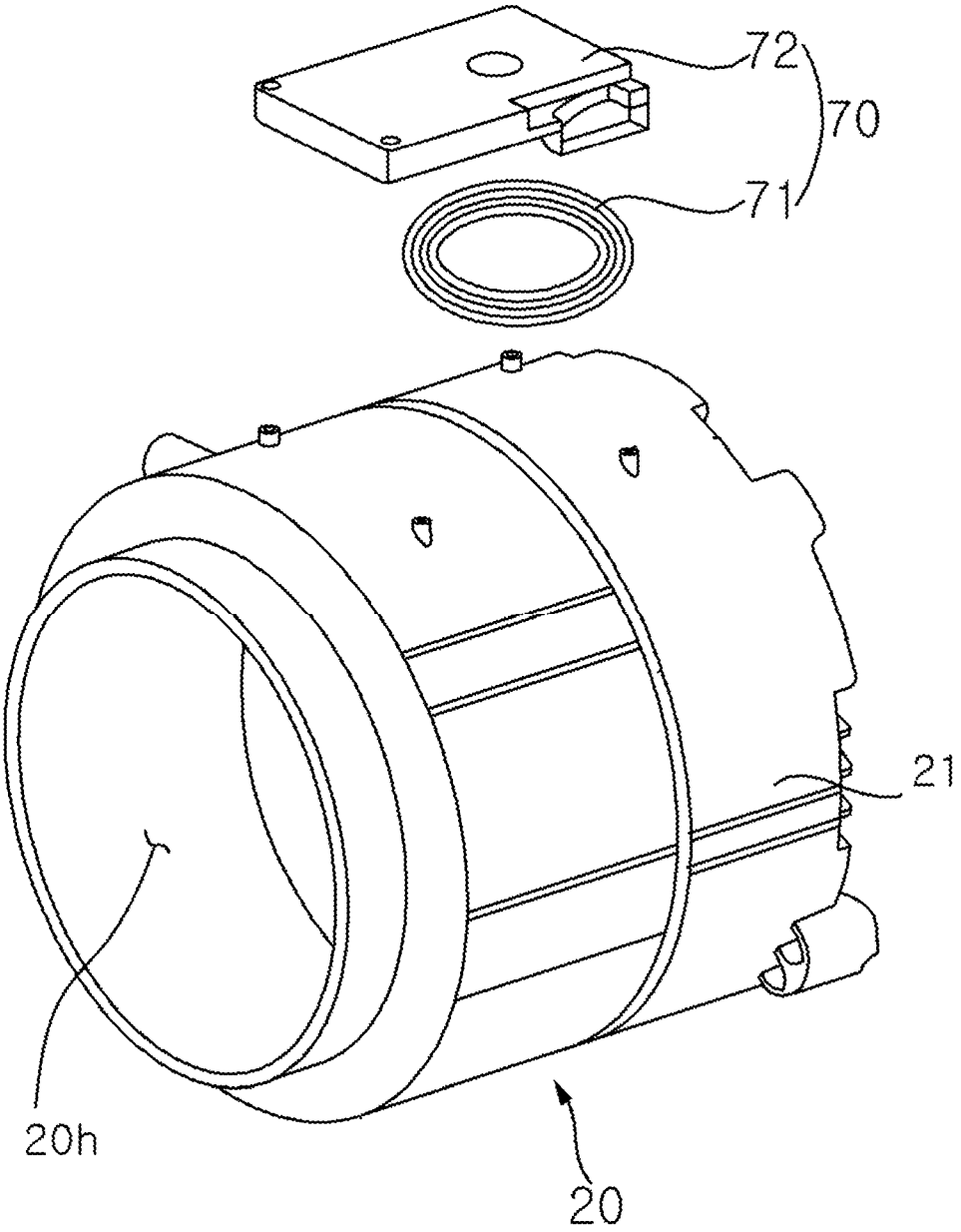
FIG. 3 is a conceptual diagram illustrating a separate induction heater module mounted to a tub.

FIG. 1 is a perspective view illustrating an external appearance of a laundry treating apparatus according to the present disclosure. FIG. 2 is a cross-sectional view illustrating an interior of a laundry treating apparatus according to the present disclosure. FIG. 3 is a conceptual diagram illustrating a separate induction heater module mounted to a tub.

Hereinafter, a laundry treating apparatus having an induction heater according to an embodiment of the present disclosure will be described with reference to FIGS. 1 to 3.

The laundry treating apparatus according to an embodiment of the present disclosure includes a cabinet 10 defining an external appearance of the laundry treating apparatus, a tub 20, a drum 30, and an induction heater 70 for heating the drum 30.

The cabinet 10 defines the external appearance of the laundry treating apparatus, and provides a space inside for the tub 20 to be installed. On the front surface of the cabinet 10, a laundry loading hole 10*h* may be formed. A door 15 for opening and closing the laundry loading hole 10*h* may be rotatably connected to the cabinet 10.

The tub 20 has an open front surface and is disposed inside the cabinet 10. The drum 30 in which laundry is accommodated is rotatably provided in the tub 20. The drum 30 may include a cylindrical portion 31 forming a cylinder elongated in a front-rear direction and having a plurality of through-holes formed therein, and a rear wall portion 32 for closing an open rear end of the cylindrical portion 31. The cylindrical portion 21 is formed of a ferromagnetic material. The rear wall portion 32 is preferably formed of a ferromagnetic material, but aspects of the present disclosure are not necessarily limited thereto.

An opening portion 33 is formed on the front surface of the drum 30 to communicate with an opening portion of the tub 20, and laundry ins loaded into the drum 30 through the opening portion 33. At least part of the drum 30 may be formed of a ferromagnetic material (or a conductive material). The ferromagnetic material is preferably stainless steel, but aspects of the present disclosure are not limited thereto.

A gasket 60 is installed so as to prevent wash water contained in the tub 20 from leaking through the opening portion formed on the front surface. The gasket 60 is formed of a soft material, and has a front end fixed to the front surface part of the cabinet 10 and a rear end fixed to the front surface part of the tub 20 so as to form a tubular-shaped passage P that extends from the laundry loading hole 10*h* to the front end of the tub 20.

The front end of the gasket 60 may be fixed to the circumference of the laundry loading hole 10*h* of the cabinet 10, and the rear end of the gasket 60 may be fixed to the circumference of the opening portion formed on the front surface of the tub 20. The induction heater 70 is provided to generate an electromagnetic field to thereby heat the drum 30. The induction heater 70 may be provided on an outer circumferential surface of the tub 20. The tub 20 may be formed of a material which is allowed to pass through the magnetic field generated by the induction heater 70. For example, the tub 20 may be formed of synthetic resin.

Each of the tub 20 and the drum 30 may take an approximate cylindrical shape. Accordingly, each of the tub 20 and the drum 30 may have an approximate cylindrical inner circumferential surface and an approximate cylindrical outer circumferential surface. FIG. 2 illustrates a laundry treating apparatus in which the drum 30 rotates about a rotation shaft parallel to the ground.

The laundry treating apparatus further comprises a driving unit 40 for driving the drum 30. The driving unit 40 further comprises a motor 41, and the motor 41 includes a stator and a rotor. The rotor is connected to a rotating shaft 42, and the rotating shaft 42 penetrates the tub 20 to be coupled to the drum 30.

A spider 43 for coupling the drum 30 and the rotating shaft 42 to each other may be provided. A rotational force of the rotating shaft 42 may be uniformly and stably transferred to the drum 30 through the spider 43.

The spider 43 is coupled to the drum 30 in a manner in which at least a portion of the spider 32 is inserted into the rear wall portion 32 of the drum 30. For this coupling, a portion of the rear wall portion 32 of the drum 30, which corresponds to the spider 43, is recessed inward, thereby reducing a laundry accommodating capacity as much as the volume of the recessed portion. The spider 43 may be coupled to the drum 30 with being recessed further inward of the drum 30 at the center of rotation of the drum 30.

A lifter 50 is provided on the inner circumferential surface of the drum 30. The lifter 50 may be provided in plural along a circumferential direction of the drum 30. Upon rotation of the drum 30, laundry is lifted by the lifter 50 to a predetermined height and falls therefrom, repeatedly. A laundry operation may be performed by employing the falling impact of the laundry.

As illustrated in FIG. 3, the induction heater 70 includes a coil 71 capable of generating eddy current in the drum 30 by generating a magnetic field with a supplied current, and a heater cover 72 for accommodating the coil 71.

The heater cover 72 may include a ferromagnetic material. The coil 71 is disposed between the ferromagnetic material and the tub 20. The ferromagnetic material may be a permanent magnet, and may include ferrite or a ferrite magnet. The heater cover 72 may cover the upper side of the coil 71, and, in this case, the ferromagnetic material such as the ferrite is disposed on the upper side of the coil 71.

The ferromagnetic material functions to make the magnetic field of the coil 71 to be concentrated toward a lower side, that is, toward the drum 30. According to an embodiment, when the coil 71 is disposed under the tub 20, the ferromagnetic material is disposed on the lower side of the coil 71.

The heater cover 72 may take a box shape having one open surface. The box shape may be in a shape in which a surface facing the drum 30 is opened and a surface opposite thereto is closed. At least one portion of the coil 71 may be positioned inside the heater cover 72. The heater cover 72 functions to protect the coil 71 from the outside.

The heater cover 72 may be spaced apart from the coil 71, and, through the space between the heater cover 72 and the coil 71, air may flow to cool the coil 71.

If the drum 30 is heated by the coil 71, temperature of wash water and/or laundry in contact with the drum 30 increases.

Furthermore, air temperature in the drum 30 is increased due to the heating of the drum 30, and thus, temperature of laundry away from the inner circumferential surface of the drum (for example, laundry positioned approximately at the center of the drum 30) is increased.

Hereinafter, the principle of how the induction heater 70 including the coil 71 heats the drum 30 will be described.

The coil 71 is a wound wire, and, when a current is applied to the coil 71, a magnetic field passing through the center of the coil 71 is generated according to Flaming's right-hand rule.

When an alternating current is applied to the coil 71, an alternating magnetic field, which is a magnetic field whose direction changes periodically, is formed. In a conductor adjacent to the alternating magnetic field, an induced magnetic field of a direction opposite to a direction of the alternating magnetic field is generated, and a change in the induced magnetic field causes an induced current to occur in the conductor.

The induced current and the induced magnetic field may be understood as inertia resulting from a change in an electric field and a magnetic field. That is, due to an induced magnetic field occurred in the coil 71, an eddy current, which is a kind of an induced current, occurs in the drum 30 which is a conductor. In this case, the eddy current is dissipated by resistance of the drum 30 and thus converted into heat. In conclusion, the drum 30 is heated by heat which is generated by the resistance, and internal temperature of the drum 30 is increased as the drum 30 is heated.

In other words, in the case where the drum 30 is a magnetic conductor such as iron (Fe), the drum 30 may be heated when an alternating current is applied to the coil 71 provided in the tub 20. Recently, stainless steel drums are widely used for better strength and sanitation. A stainless steel material has relatively excellent electric conductivity and thus it may be heated easily due to a change in an electromagnetic field.

A heat pump or a sheath heater which is a heating source in a conventional laundry treating apparatus having a stainless steel drum may be replaced by the induction heater 70.

The induction heater 70 having the coil 71 and the heater cover 72 may be provided on the inner circumferential surface of the tub 20. The strength of a magnetic field decreases with distance, so it may be advantageous for the induction heater 70 to be provided on the inner circumferential surface of the tub 20 so as to reduce a gap with the drum 30.

However, the tub 20 will contain wash water and vibration will occur upon rotation of the drum 30. Considering the above, it is preferable to provide the induction heater 70 on the outer circumferential surface of the tub 20 for safety. Furthermore, since it is very humid inside the tub 20, it is preferable to arrange the induction heater 70 on the outside of the tub 20 for insulation and safety of the coil 71.

According to an alternative embodiment, the coil 71 may be wound around the whole outer circumferential surface of the tub 20 at least one time. However, if the coil 71 is wound around the whole circumference of the tub 20, the coil 71 should be too much long, and a short circuit may occurs when wash water leaked from the tub 20 comes into contact with the coil 71.

Thus, the coil 71 is provided on the outer circumferential surface of the tub 20, and preferably on a portion of the circumferential surface of the tub 20. That is, the coil 71 is not provided to surround the whole outer circumferential surface of the tub 20, but provided in a predetermined area from the front to the rear of the tub 20. It may be for efficiency in heat dissipation of the drum 30 relative to output of the induction heater 70. In addition, it may be for efficiency in manufacturing the laundry treating apparatus in consideration of a space between the tub 20 and the cabinet 10.

The coil 71 is preferably formed of a single layer. That is, a wire is preferably to be wound not in multiple layers, but in a single layer. The coil 71 may be spirally wound on a single surface.

Meanwhile, in the case where a wire is wound into multiple layers (that is, having the same shape as that of a coil spring), a distance from each layer to the drum 30 differs. Accordingly, there is a problem that a layer is less efficient when the corresponding layer is positioned further from the drum 30. Therefore, it is preferable that the coil 71 is formed of a single layer. This may mean that it is possible to achieve the maximum coil area in adjacency to the drum 30 with a wire of the same length.

FIG. 3 illustrates that the induction heater 70 is provided on an upper side of the tub 20. However, aspects of the present disclosure are not limited thereto, and the induction heater 70 may be provided on at least one surface of the upper side, the lower side, or either lateral side of the tub 20.

The induction heater 70 may be provided on one side of the outer circumferential surface of the tub 20, and the coil 71 may be provided in the induction heater 70 with being wound at least one time.

The induction heater 70 may to generate an eddy current on the drum 30 by irradiating an induced magnetic field directly on the outer circumferential surface of the drum 30, and may, in conclusion, directly heating the outer circumferential surface of the drum 30.

Although not illustrated in the drawings, the induction heater 70 may be connected to an external power supply with an electric wire to receive power, and may be connected to a controller for controlling operations of the laundry treating apparatus to receive power. In addition, a module controller for controlling output of the induction heater 70 may be provided additionally. The module controller may control turning-on/off and output of the induction heater 70 under control of the controller. Aspects of the present disclosure are not limited thereto, and the induction heater 70 may receive power from any one as long as the induction heater 70 is allowed to supply power to the coil 71.

As power is supplied to the induction heater 70, the drum 30 may rotate while the drum 30 is heated. If the drum 30 is in a stopped state while the induction heater 70 operates, only a particular portion of the drum 30 is heated. In this case, the drum 30 is locally overheated, and the rest of the drum 30 may be not heated at all or may be heated insufficiently. This leads to a problem of not smoothly supplying heat to laundry accommodated in the drum 30. Therefore, the drum 30 is controlled to rotate by the driver 40 upon operation of the induction heater 70, thereby uniformly heating the drum 30 and accordingly uniformly transferring heat to laundry items.

In addition, the outer circumferential surface of the drum 30 may be uniformly heated even in the case where the induction heater 70 is installed to one of the upside, the lower side, and both lateral sides of the tub 20, rather than being installed to all of them.

According to an embodiment of the present disclosure, the drum 30 may be heated up to 120 Celsius Degrees or more in a short period of time upon driving of the induction heater 70. If the induction heater 70 is driven when the drum 30 is stopped or rotating very slowly, a particular portion of the drum 30 may be heated very fast. It is because heat is not transferred uniformly to laundry items in the drum 30.

For this reason, correlation between a rotational speed of the drum 30 and driving of the induction heater 70 is very critical. In addition, it is more preferable to driving the induction heater 70 after rotation of the drum 30 over rotating the drum 30 after driving of the induction heater 70.

In a conventional technique in which heat is transferred from a heater to laundry via wash water as the heater is heated while soaked in water inside the tub 20, temperature can be increased only when the laundry is sufficiently soaked in the wash water. However, the laundry treating apparatus according to an embodiment of the present disclosure enables transferring heat via the drum 30, not just via wash water, and therefore, laundry may be heated to a desired degree even in the case where the wash water is supplied less than it is required in the existing technique.

For example, laundry is not necessarily soaked in wash water for sterilization, and thus, unnecessary consumption of the wash water may be prevented. It is because the laundry is allowed to receive heat not via the wash water, but via the drum 30. In addition, as steam or humid air generated as a result of heating wet laundry makes the inside of the drum 30 a very humid environment of high temperature, which may help sterilize the laundry more effectively.

Accordingly, in a hot-water washing course of soaking laundry in heated wash water to wash, a less amount of wash water may be used compared to the existing technique and power required to heat the water may be reduced.

In addition, an amount of wash water used to increase temperature of laundry may be reduced, and accordingly, a time of supplying the wash water may be reduced. It is because an amount of wash water additionally supplied after soaking laundry and a time for the additional supply of wash water may be reduced. Therefore, a washing time may be reduced further.

Here, the level of detergent-contained wash water may be lower than the bottom of the drum 30. In this case, the wash water in the tub 20 may be supplied into the drum 30 using a circulation pump, and thus, a small amount of wash water may be used more effectively.

In addition, the heater provided under the tub 20 to heat wash water may be omitted to simplify the structure and increase the capacity of the tub 20.

In particular, a heater generally provided inside the tub 20 has a small area to be brought into contact with air or wash water, and thus, heating performance of the heater is not excellent. However, in the case of the present disclosure, the whole inner circumferential surface of the drum 30 serves as a heating surface, and thus, heating performance improves.

In the conventional method in which heating is performed by a heater in the tub 20 in a washing operation, the heater heats wash water and the heated wash water increases temperature of the drum 30, laundry, and the inner space of the drum 30. Accordingly, it takes a long time to heat the whole a high temperature.

However, as described above, the circumferential surface of the drum 30 has a relatively large area to be brought in contact with wash water, laundry, and internal air of the drum 30. In addition, the heated rum 30 heats the wash water, the laundry, and the internal air of the drum 30, and thus, it may be more effective to use the induction heater 70 as a heating source for a washing operation, compared to the existing technique having a heater inside the tub 20.

In addition, the method in which wash water is heated by the induction heater 70 during rotation of the drum 30 may allow the circumferential surface of the drum 30 to be uniformly heated, and thus, the heating area may become larger and accordingly a time for heating wash water may be reduced. Furthermore, when detergent is added into the tub 20, the detergent may be easily dissolved by a water flow caused by the rotation of the drum 30.

Figure 4:
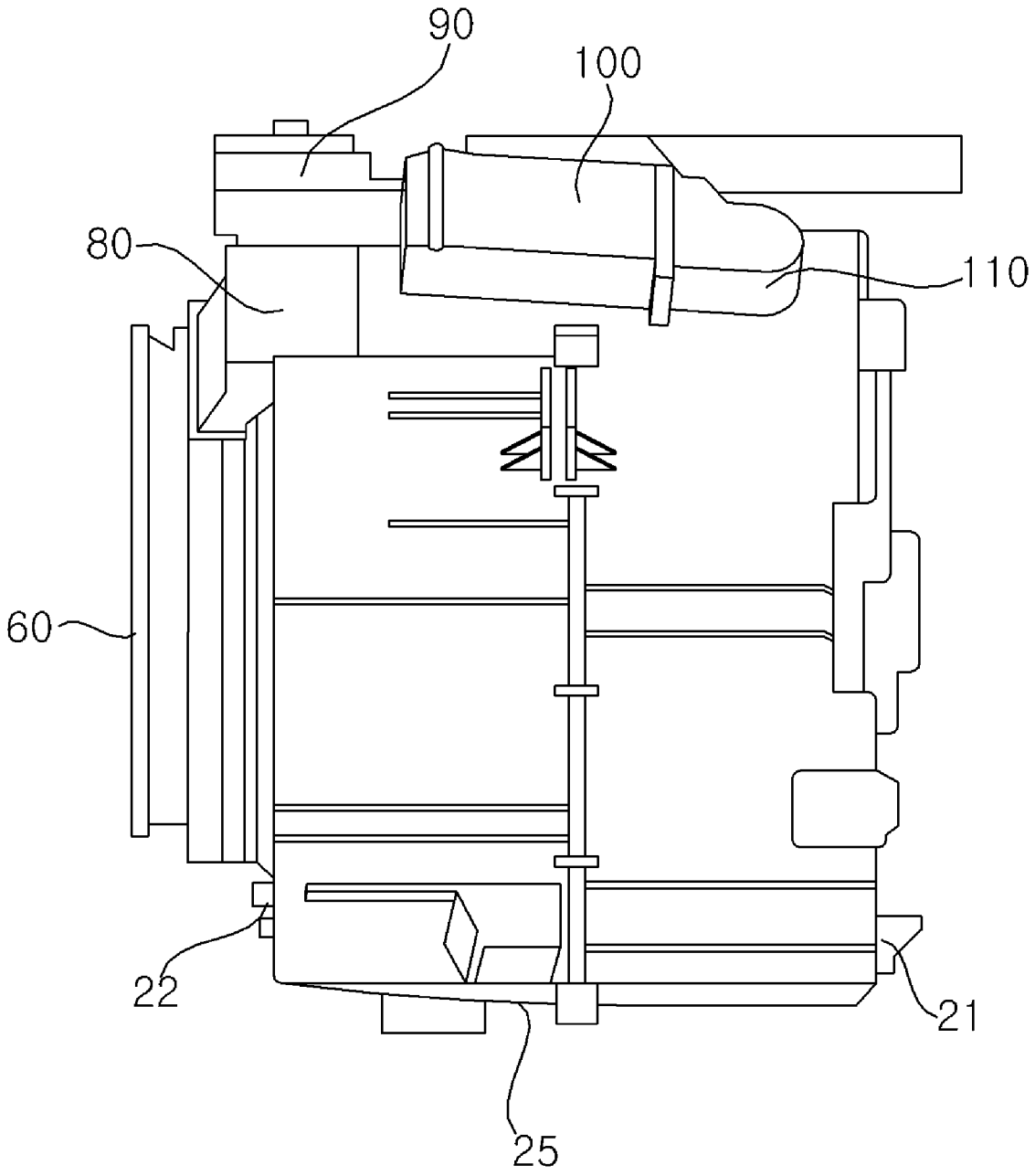
FIG. 4 is a diagram illustrating an external appearance of a tub according to an embodiment of the present disclosure 4.
Figure 5:
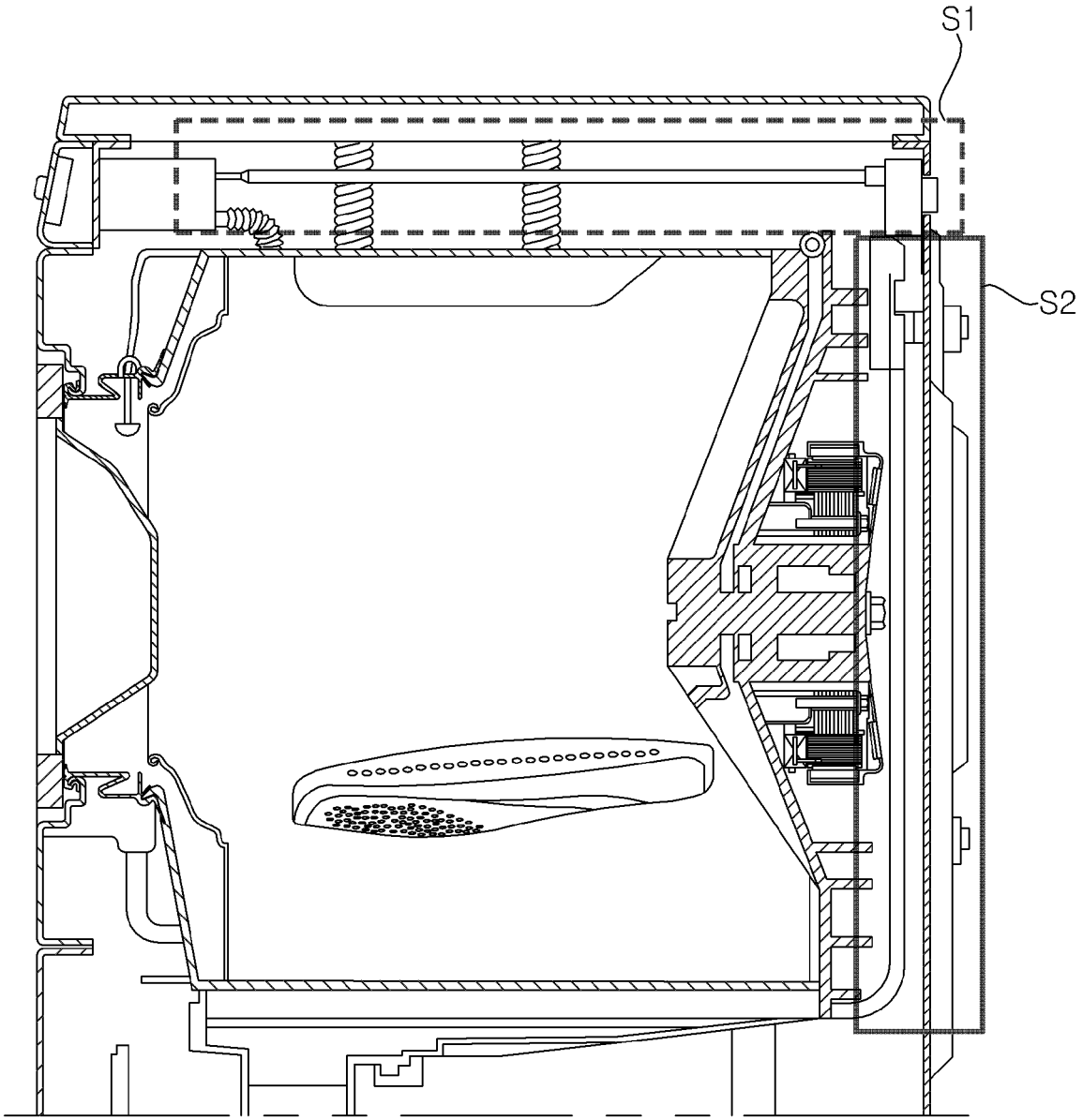
FIG. 5 is a cross-sectional view illustrating an example in which a space behind the tub is removed and a duct is provided on an upper side of the tub.
Figure 6A:
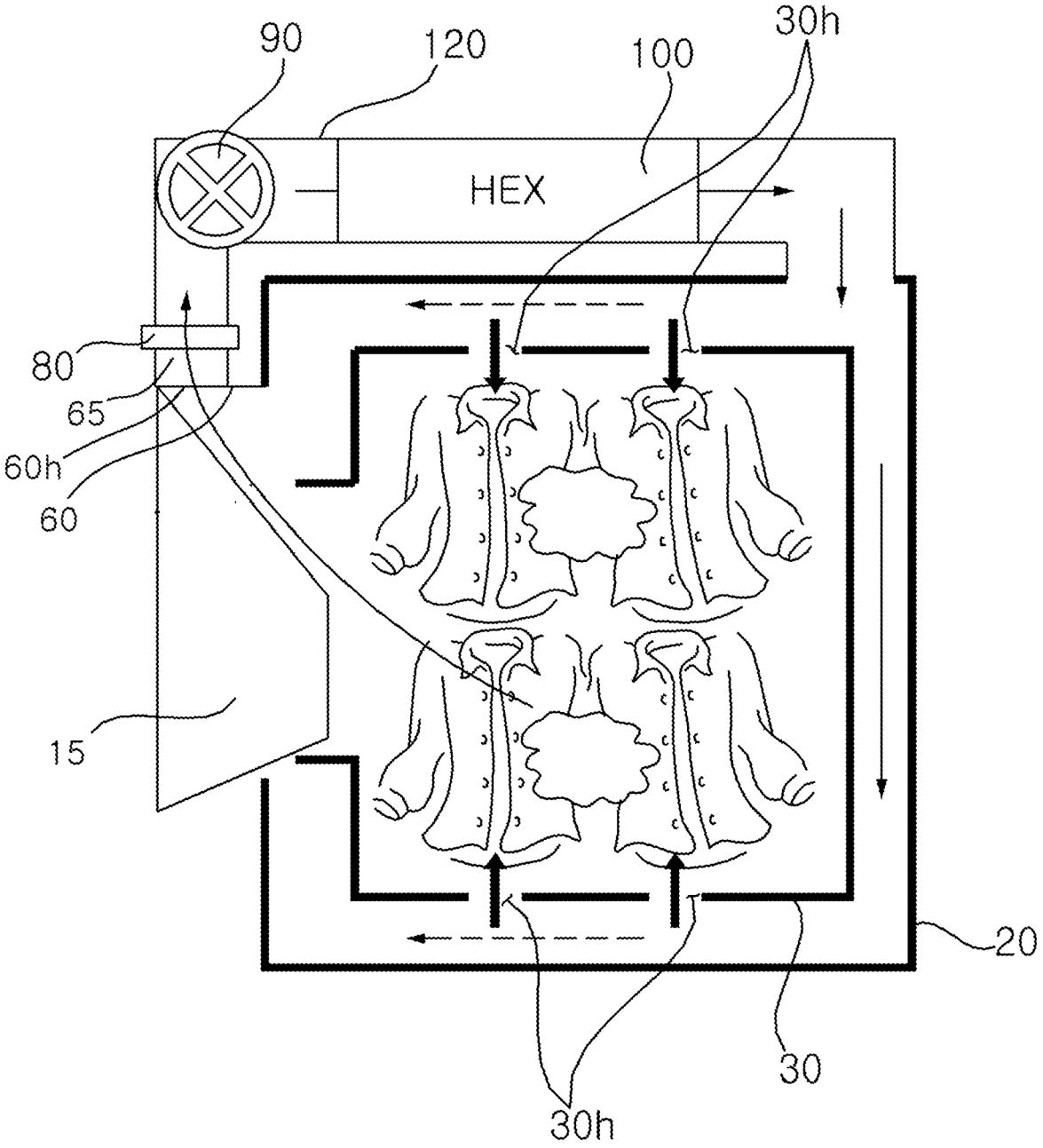
FIG. 6A is a diagram illustrating a hot air circulating structure according to an embodiment of the present disclosure.

FIG. 4 is a diagram illustrating an external appearance of a tub according to an embodiment of the present disclosure 4. FIG. 5 is a cross-sectional view illustrating an example in which a space behind the tub is removed and a duct is provided on an upper side of the tub. FIG. 6A is a diagram illustrating a hot air circulating structure according to an embodiment of the present disclosure.

Referring to FIGS. 4 to 6B, the hot air circulating structure according to an embodiment of the present disclosure will be 20 described.

A duct 120 serves to guide circulating air and is disposed on an outer side of the tub 20. The duct 120 guides air discharged from the tub 20 to be supplied back into the tub 20. One end of the duct 120 may communicate with the opening portion 33 at the front of the drum 30.

The duct 120 extends rearward from the front end thereof communicating with the drum 30 such that the rear end of the duct 120 communicates with a side surface 21 of the tub 20. When an air blower 90 which will be described later operates, an air flow is introduced from the drum 30 into the front end of the duct 120 and discharged into the tub 20 through the rear end of the duct 120. The front end of the duct 120 corresponds to an inlet through which air is introduced into the duct 120, and the rear end of the duct 120 corresponds to an outlet from which air is discharged from the duct 120.

Referring to FIG. 5, a duct conventionally passes through an upper space S1 of a tub to extend to a rear surface S2 of the tub and be coupled to a lower portion of the rear wall of the tub. In this structure, there are problems that a front-rear length of the tub 20 is inevitably restricted by the rear space S2 and that the capacity of the drum 30 is reduced.

The duct 120 according to an embodiment of the present disclosure does not occupy the rear space of the tub 20, and the outlet of the duct 120 is connected to the side surface 21 of the tub 20. Accordingly, unlike the conventional structure, the duct 120 is not positioned in the rear space S2 of the tub 20, so the rear space S2 of the tub 20 may be secured and the capacity (an accommodating space) of the drum 30 may be expanded up to the rear space S2 of the tub 20.

The front end of the duct 120 may be coupled to the gasket 60. A duct mount 65 may be formed in the gasket 60. In this case, the front end of the duct 120 is coupled to the duct mount 65. The duct mount 65 may be formed on an upper side of the gasket 60.

A lint filter 80 is installed in the duct mount 65. A lint is textile fibers coming off from clothing during a drying operation, and the lint is collected by the lint filter 80. Accordingly, cleaning of laundry may improve, and the laundry treating apparatus may be prevented from damage or malfunction caused due to circulation of a foreign substance.

Since an air flow is introduced into the duct 120 through the lint filter 80, lint is filtered out before the air flow comes into the duct 120.

The air blower 90 may be installed in the duct 120. The air blower 90 may be disposed downstream of the lint filter 80. The air flower 90 serves to make internal air of the drum 30 circulate through the duct 120. As the air blower 90 rotates, air flow is formed such that air is discharged from the drum 30 and introduced into the inlet formed at the front of the duct 120 and then passes through the lint filter 80 and the air blower 90.

A heat exchanger 100 for cooling a circulating air flow may be provided in the duct 120. The heat exchanger 100 may be disposed downstream of the air blower 90. The heat exchanger 100 may include a heat absorption portion (not shown) for absorbing heat from ambient air, and a heat dissipation portion (not shown) for transferring heat to ambient air. The heat absorption portion may be disposed in the duct 120, and the heat dissipation portion may be disposed on an outer side of the duct 120.

The heat exchanger 100 may include a heat pump which configures a series of circulation cycles to compress, condense, expand, and evaporate a refrigerant. The heat pump may include: a compressor for compressing a refrigerant flowing along a refrigerant pipe; a refrigerant condenser for transferring heat from the refrigerant compressed by the compressor to the ambient air so as to condense the refrigerant; an expansion unit for expanding the refrigerant condensed by the refrigerant condenser; and a refrigerant evaporator for absorbing heat from ambient air to evaporate the refrigerant expanded by the expansion unit. In this case, the refrigerant evaporator may constitute the heat absorption portion.

In another example, the heat exchanger 100 may include a thermoelectric element, and, in this case, a heat absorption surface of the thermoelectric element may constitute the heat absorption portion. In yet another example, the heat absorption portion may include an air cooler or a liquid cooler.

Air having passed through the air blower 90 passes through the heat exchanger 100, and, at this point, moisture contained in the air is condensed to make a dry air flow of low temperature.

As internal air of the drum 30 is introduced into the duct 120 and passes through the heat exchanger 100, humid air becomes dry and then the dry air is supplied into the drum 30.

Figure 6B:
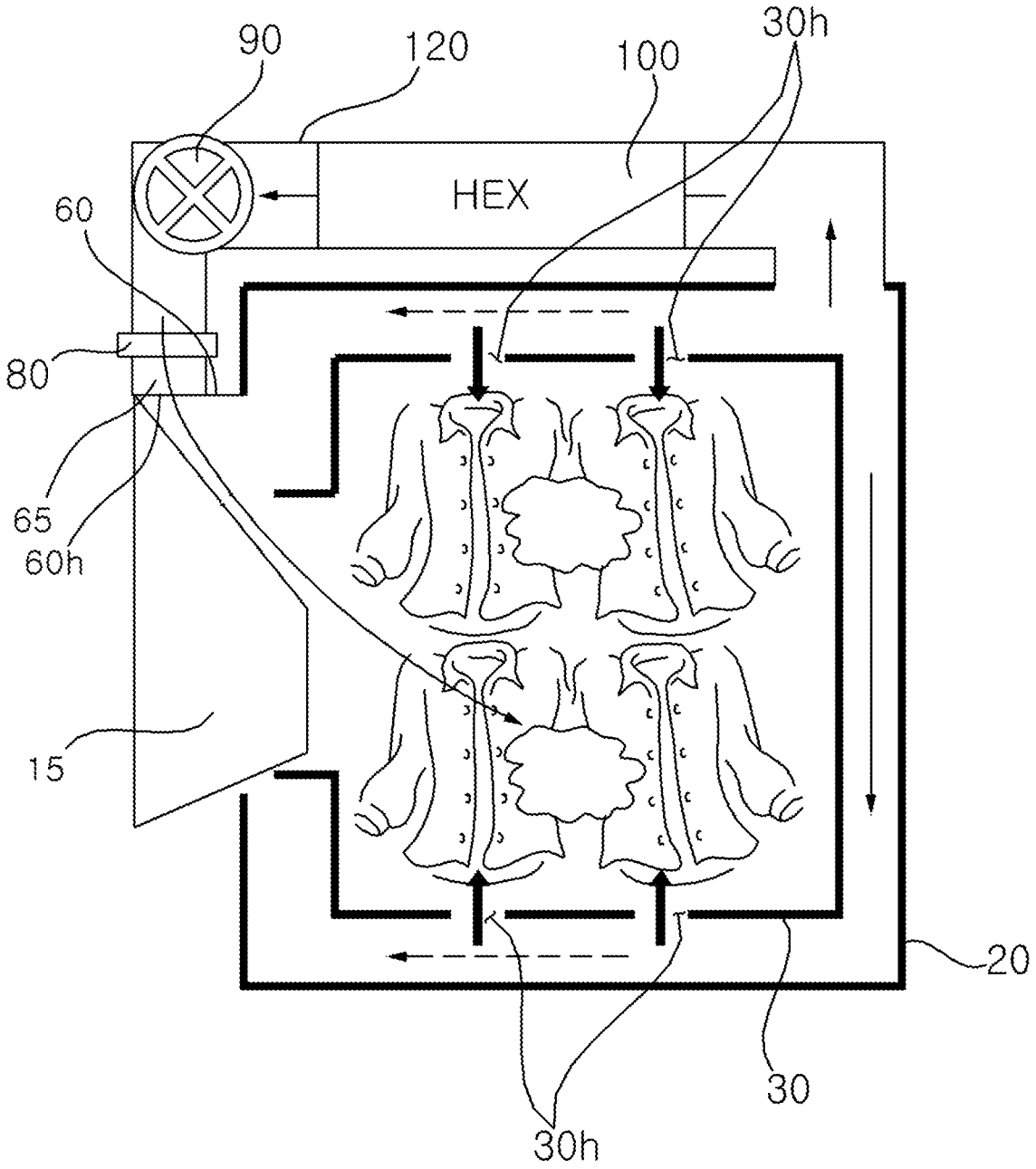
FIG. 6B is a diagram illustrating an example in which a hot air circulating direction is reversed.

FIG. 6A is a diagram illustrating a hot air circulating structure according to an embodiment of the present disclosure. FIG. 6B is a diagram illustrating the case where a hot air circulating direction is reversed.

Hereinafter, movement of air flow according to an embodiment of the present disclosure will be described with reference to FIGS. 6A and 6B.

While the drum 30 rotates, the induction heater 70 operates. The drum 30 is heated by the induction heater 70, and accordingly, air temperature in the drum 30 is increased.

Once the air blower 90 operates, hot and humid air in the drum 30 is introduced into the duct 120, which is installed to the duct amount 65 of the gasket 60, through the front end of the duct 120. The air introduced into the duct 120 is filtered through the lint filter 80, and the filtered air passes through the air blower 90. The air having passed the air blower 90 passes through the heat exchanger 100, and, in this course, moisture in the air is condensed to make the air dry. The dry air is discharged into the tub 20 through the outlet formed on the other side of the duct 120. The air discharged into the tub 20 flows into the drum 30 through through-holes 30*h*, formed on the circumferential surface of the drum 30, to dry laundry.

A hollow, which is defined by the gasket 60 when the door 15 is closed, is substantially almost sealed by the rear part of the door 15, and the through-holes 30*h* are not formed on the rear wall portion 32 of the drum 30. Accordingly, the dry air discharged from the duct 120 is introduced into the drum 30 through the through-holes 30*h* formed on the circumferential surface of the drum 30. Since circulating air (dry air) supplied into the drum 30 flows in one direction, flow resistance may be reduced and the air may be heated uniformly.

On the contrary, a hot air circulating structure for a conventional drying operation is formed as follows: a heater is provided in a duct provided on an outer side of a tub and air heated by the heater is supplied into a drum by an air blower to dry laundry. In this course, when humid air passes through a condenser (or a cooler), moisture is removed (or condensed) from the humid air and the flows back into the heater. Here, the outlet of the duct, through which air is discharged, communicates with an upper area of the open front surface of the tub, and the inlet of the duct, through which air is introduced, communicates with the inside of the tub through an opening portion formed on the rear wall of the tub.

Therefore, most of the heated air discharged through the inlet of the duct flows rearward through a space between the tub and the drum, and is then introduced into the inlet of the duct, which is coupled to the rear wall of the tub, without being heat-exchanged with laundry.

Meanwhile, the present disclosure relates to a method of heating the drum 30 using the induction heater 70. Thus, a simple structure may be achieved because a heater is not required to be positioned in the duct 120, and unnecessary heat loss may be reduced because the drum 30 is heated directly.

In addition, most of air introduced into the tub 20 participates in drying laundry, and thus, an amount of air to be supplied into the tub 20 may be reduced.

FIG. 6B illustrates the case where air circulates in a direction reverse to the direction shown in FIG. 6A. In the case where air flows in the reverse direction, some of air introduced into the tub 20 through the duct 120 is introduced into the drum 30 through the opening portion of the front surface of the drum 30, while other air is introduced into a cylindrical space between the circumferential surface of the drum 30 and the circumferential surface of the tub 20.

In this case, the air introduced directly into the drum 30 through the opening portion 33 formed on the front surface of the drum 30 is introduced into the drum 30 without contacting the circumferential surface of the drum 30 which is subject to heating, and therefore, air temperature is not high. In the case where air flows in the reverse direction, dry efficiency by the air introduced into the drum 30 is inevitable to be relatively low.

On the contrary, if an air flow of a forward direction is formed, as shown in FIG. 6A, a more amount of air is brought into contact with the circumferential surface of the tub 20 to be heated and supplied into the drum 30 through the through-holes 30*h*, thereby drying laundry more effectively.

Figure 7A:
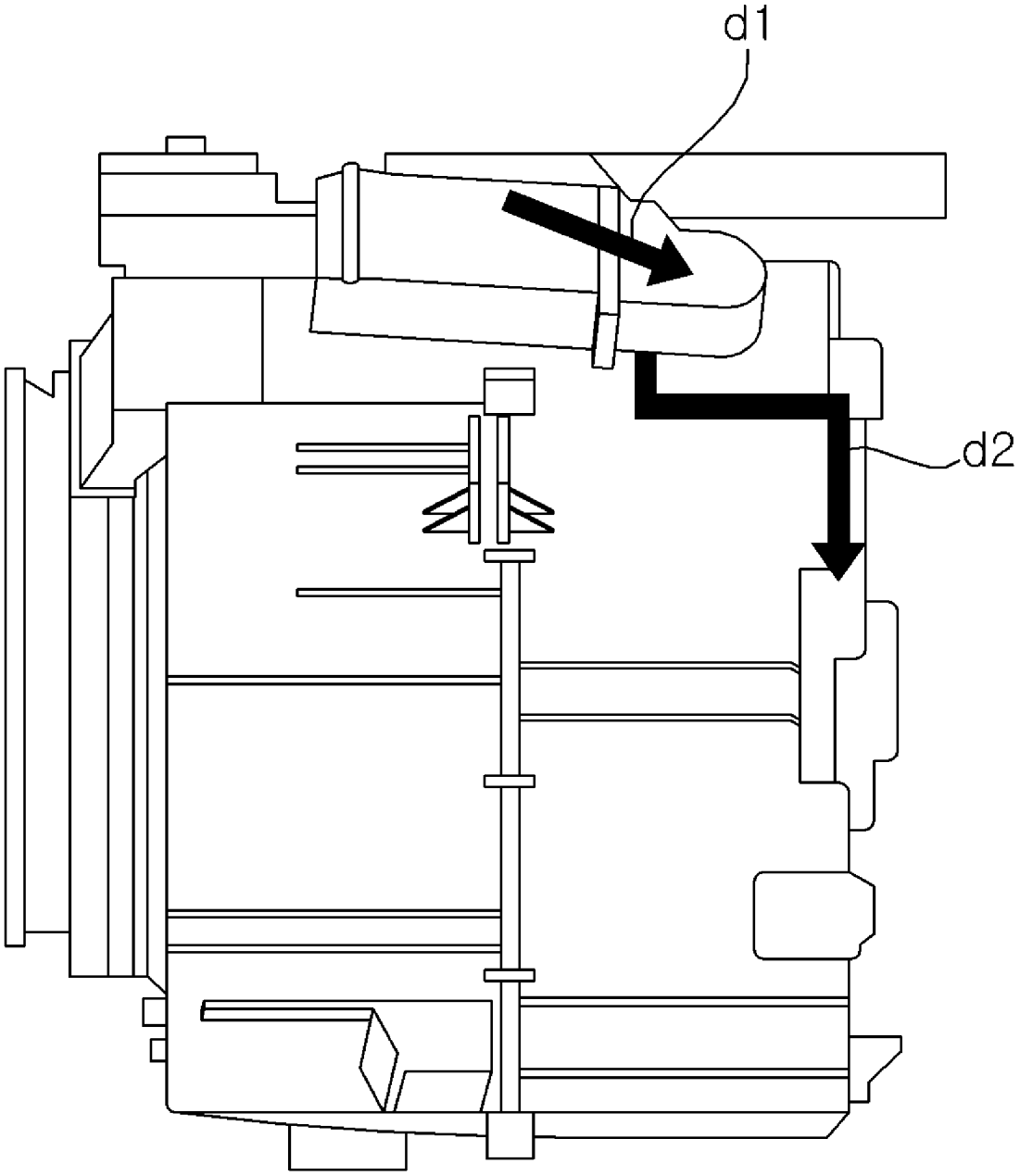
FIG. 7A is a diagram illustrating a direction of draining condensed water through a heat exchanger.
Figure 7B:
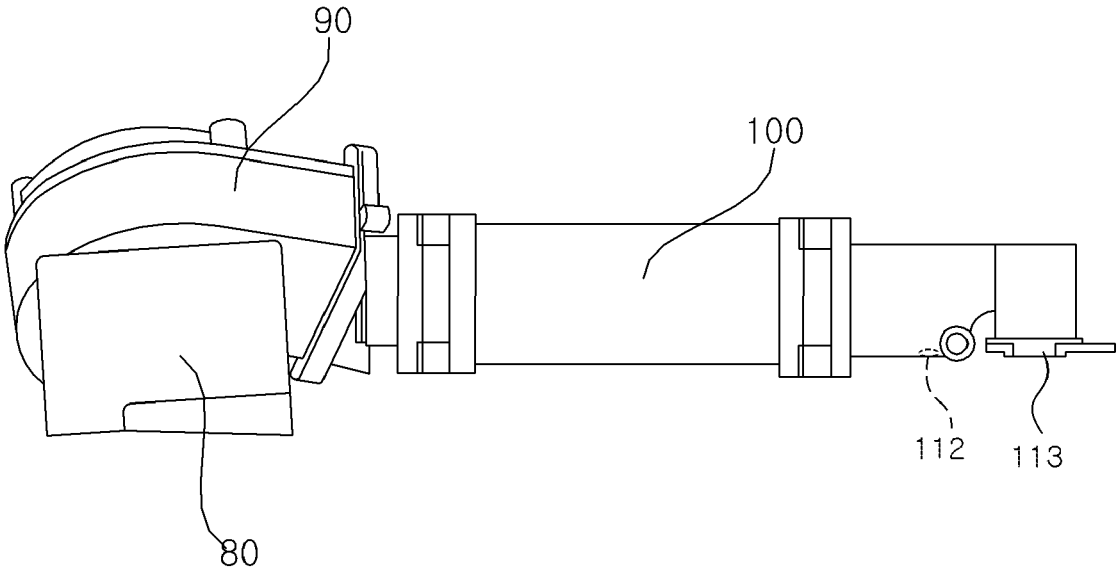
FIG. 7B is an enlarged view of a filter, a fan, a heat exchanger, and a discharge part for draining condensing water.
Figure 7C:
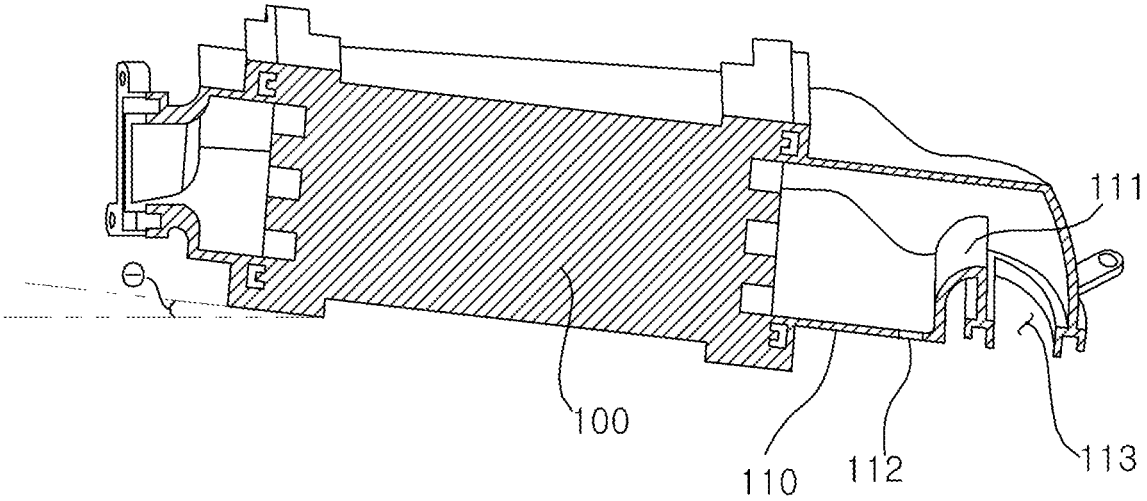
FIG. 7C is an inclined discharge part and a separator.

FIG. 7A is a diagram illustrating a direction of draining condensed water through a heat exchanger. FIG. 7B is an enlarged view of a filter, a fan, a heat exchanger, and a discharge part for draining condensing water. FIG. 7C is an inclined discharge part and a separator.

Hereinafter, a structure of draining condensed water through a heat exchanger will be described with reference to FIGS. 7A to 7C.

Air containing moisture as a result of contact with laundry in the drum 30 is introduced into the duct 120 when the air blower 90 rotates. In this course, an air flow passes through the lint filter 80, the air blower 90, and the heat exchanger 100 in order. At this point, the moisture contained in the air is condensed after contacting the heat exchanger 100, and therefore, the air becomes dry in low temperature after passing through the heat exchanger 100.

The heat exchanger 100 is installed to be inclined downward to the rear. An arrow d1 in FIG. 7A indicates a direction in which water condensed by the heat exchanger 100 (hereinafter, referred to as "condensed water") flows down along the inclination.

The heat exchanger 100 may be formed such that a guide surface 110, along which the condensed water flows, is inclined downward by a preset angle θ toward the rear (or toward a condensed water discharge port 112). The condensed water flows down the guide surface 110 by the force of gravity and is the discharged through the condensed water discharge port 112.

The condensed water discharged through the condensed water discharge port 112 flows down the outer circumferential surface of the tub 20. There may be further provided a condensed water drain pipe d2 having one end connected to the discharge port 112 and the other end communicating with the inside of the tub 20 through the side surface 21 of the tub 20.

Meanwhile, the heat exchanger 100 may include a separator 111 protruding from the guide surface 110. In this case, the condensed water discharge port 112 may be formed at an upstream side of the separator 111, and an air discharge port 113 may be formed at a downstream side of the separator 111. The separator 111 may have a surface convex toward an upstream side of air flow, and a concave surface opposite to the convex surface, and accordingly, the separator 111 may have a cross-sectional shape which is approximately arc.

The drain pipe d2 may be connected to the condensed water discharge port 112.

Condensed water, condensed by the heat exchanger 100, may be discharged through the condensed water discharge port 112. In particular, running of the condensed water is blocked by the separator 111, so all of the condensed water is substantially discharged through the condensed water discharge port 112.

The condensed water discharged through the condensed water discharge port 112 is guided along the drain pipe d2 to be discharged into the tub 20. In this case, the condensed water flows down the inner circumferential surface of the tub 20 to be gathered at the bottom of the tub 20. Alternatively, the condensed water discharge port 112 may be connected directly to the circumferential surface of the tub 20.

Meanwhile, air having passed through the heat exchanger 100 flows over the separator 111 to be discharged through the air discharge port 113. The air discharge port 113 communicates with the inside of the tub 20 through a connection port formed on the circumferential surface of the tub 20. The upper surface of the separator 111 is convexly curved, and thus, flow resistance may be reduced. The height of the separator 111 is preferably 1 cm to 2 cm from the guide surface 110, but aspects of the present disclosure are not necessarily limited thereto.

Figure 8:
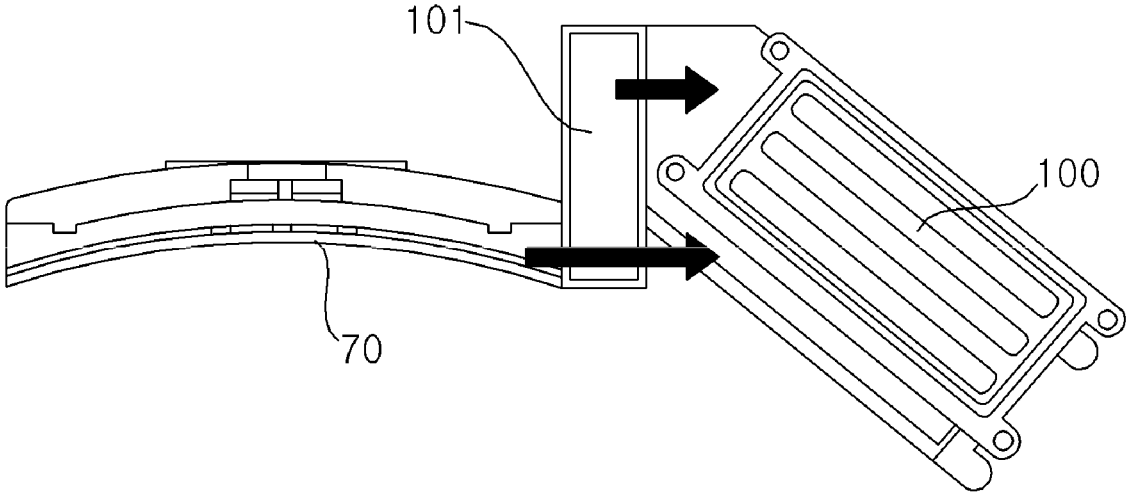
FIG. 8 is a diagram illustrating an example a cooling fan is applied to both a heater and a heat exchanger.

FIG. 8 is a diagram illustrating an example a cooling fan is applied to both a heater and a heat exchanger.

Hereinafter, a position and a function of the cooling fan will be described with reference to FIG. 8.

The heat exchanger 100 dehumidify humid air in the duct 120 using a refrigerant in a refrigerant evaporating process, and heats the dehumidified air again in a refrigerant condensing process. In the case where the heat exchanger 100 includes a heat pump as shown in the present embodiment, the process of dehumidifying the air is performed by the refrigerant evaporator and the process of heating the dehumidified air is performed by the refrigerant condenser. A cooling fan 101 for cooling the refrigerant condenser (not shown) may be provided. Since heat generated by the refrigerant is extinguished by the cooling fan 101, a refrigerant may be condensed more smoothly and the overall efficiency of the heat pump may improve.

In addition, it takes a long time for the induction heater 70 to heat the drum 30, possibly leading to malfunction or damage to the heater due to an amount of dissipated heat. Even after the induction heater 70 is turned off, residual heat remains, and which may cause an error in performing a dry function and any other function. Therefore, there is a need of a device for cooling the induction heater 70.

As shown in the present embodiment, in the case where both the heat exchanger 100 and the induction heater 70 are disposed on the upper side of the tub 20, it is possible to cool the heat exchanger 100 and the induction heater 70 using a single cooling fan 101. In doing so, the cooling fan 101 may be shared, and accordingly, power saving and a simple inner structure may be achieved at the same time. That is, the cooling fan 101 may be disposed on the upper side of the tub 20.

Figure 9:
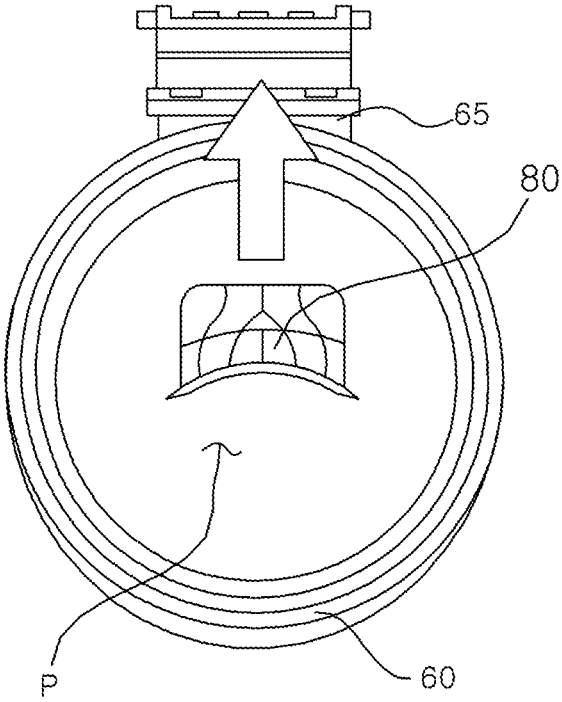
FIG. 9 is a diagram illustrating a detachable lint filter. Hereinafter, a position and a function of the lint filter will be described with reference to FIG. 9.

FIG. 9 is a diagram illustrating a detachable lint filter. Hereinafter, a position and a function of the lint filter will be described with reference to FIG. 9.

Lint is textile fibers coming off clothing during a drying operation, and the lint filter 80 is a device for filtering the lint in an air circulating process so that air circulating in the drum 30 is kept clean.

The lint filter 80 is installed on the inlet side of the duct 120. Preferably, the lint filter 80 may be detachably provided in the duct mount 65 formed in the gasket 60.

The duct mount 65 is in a tubular shape protruding from the outer circumferential surface of the gasket 60, and the duct 120 is inserted into an opening portion at the upper end of the duct mount 65. An opening portion 60*h* communicating with the duct mount 65 and allowing air to be introduced into the duct 120 is formed on the inner circumferential surface of the gasket 60, and the lint filter 80 may be inserted into the opening portion 60*h*. The duct mount 65 may be integrally formed with the gasket 60.

The lint filter 80 prevents lint from being accumulated in the duct or from blocking a flow path to obstruct air circulation. In doing so, degradation of dry performance may be prevented and a dry operation may be performed efficiently.

When the door 15 is opened, the opening portion 60*h* is exposed to the outside. Accordingly, a user is allowed to easily detach the lint filter 80 through the opening portion 60*h* to wash.

The accompanying drawings are provided only for a better understanding of the embodiments disclosed in the present specification and are not intended to limit the technical ideas disclosed in the present specification. Therefore, it should be understood that the accompanying drawings include all modifications, equivalents and substitutions included in the scope and sprit of the present disclosure.

In addition, although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternatives uses will also be apparent to those skilled in the art.

What is claimed is:

1. A laundry treating apparatus comprising:

a cabinet that defines an external appearance of the laundry treating apparatus;

a tub disposed in the cabinet;

a drum disposed in the tub and configured to rotate relative to the tub, the drum comprising:

a cylindrical portion that is made of a ferromagnetic material, that defines a front opening at a front surface of the drum configured to receive laundry, and that defines a plurality of through-holes that are in communication with an inside of the drum, and a rear wall portion that covers a rear opening of the cylindrical portion;

an induction heater disposed at the tub and configured to heat the drum based on inducing an eddy current in the cylindrical portion to thereby heat air in the drum;

a duct disposed at an outer side of the tub, the duct having an inlet that is in communication with the front opening of the cylindrical portion of the drum, and an outlet that is in communication with the tub through a side surface of the tub surrounding the cylindrical portion of the drum; and an air blower configured to suction air from the drum into the inlet of the duct to thereby generate an air flow in a direction from the inlet of the duct toward the outlet of the duct, the outlet of the duct being configured to discharge a dry air having a low temperature relative to a temperature of the air suctioned into the inlet of the duct, wherein the induction heater is further configured to heat the dry air discharged through the outlet of the duct such that the dry air is heated and supplied into the drum through the plurality of through-holes.

2. The laundry treating apparatus of claim 1, further comprising:

a lint filter configured to filter lint from air introduced into the duct; and a heat exchanger configured to condense moisture from air in the duct.

3. The laundry treating apparatus of claim 2, wherein the air blower is disposed downstream of the lint filter and configured to receive air having passed the lint filter, and wherein the heat exchanger is disposed downstream of the air blower and configured to receive air having passed the air blower.

4. The laundry treating apparatus of claim 2, wherein the heat exchanger comprises a guide surface that is configured to guide water condensed from moisture in air in the duct, that is inclined downward toward the tub, and that defines a condensed water discharge port that is in communication with the tub.

5. The laundry treating apparatus of claim 4, further comprising a drain pipe that connects the condensed water discharge port to the tub.

6. The laundry treating apparatus of claim 4, wherein the heat exchanger further comprises:

an air discharge port configured to discharge, into the tub, air guided through the guide surface along the duct; and a separator that protrudes from the guide surface and is disposed between the condensed water discharge port and the air discharge port.

7. The laundry treating apparatus of claim 6, wherein the separator comprises a surface that is convex toward an upstream side of the air flow guided along the duct.

8. The laundry treating apparatus of claim 4, wherein the guide surface is configured to discharge condensed water through the condensed water discharge port and to allow the condensed water to flow downward along an inner circumferential surface of the tub.

9. The laundry treating apparatus of claim 1, further comprising a heat exchanger configured to condense moisture from air in the duct, wherein the heat exchanger comprises:

a refrigerant pipe configured to flow refrigerant;

a heat absorption portion disposed in the duct and configured to absorb heat from ambient air outside the duct and evaporate the refrigerant flowing along the refrigerant pipe; and a heat dissipation portion disposed at an outer side of the duct and configured to transfer heat from the refrigerant to the ambient air, and wherein the laundry treating apparatus further comprises a cooling fan configured to blow air toward the heat exchanger and cool the heat dissipation portion and the induction heater.

10. The laundry treating apparatus of claim 1, wherein the cabinet defines a laundry loading hole at a front surface of the cabinet, wherein the tub defines a tub opening at a front surface of the tub, the tub opening that is in communication with the laundry loading hole, wherein the tub comprises:

a gasket that is made of a soft material and that defines a passage having a tubular shape that extends from the laundry loading hole to the tub opening, the gasket having a front end coupled to the front surface of the cabinet and a rear end coupled to the front surface of the tub; and a duct mount having a tubular shape that protrudes from an outer circumferential surface of the gasket, the duct mount receiving an inlet end of the duct, and wherein the gasket comprises:

a gasket opening portion that is in communication with the duct mount and that is disposed at an inner circumferential surface of the gasket facing the passage, and a lint filter detachably inserted into the gasket opening portion and configured to filter air entering the duct.

11. The laundry treating apparatus of claim 1, wherein the induction heater is disposed at an upper side of the tub.

12. The laundry treating apparatus of claim 1, wherein the induction heater comprises a coil that includes a wire that is spirally wound and that is disposed at a single predetermined surface of the tub.

13. The laundry treating apparatus of claim 12, wherein the induction heater comprises a heater cover that covers the coil, and wherein the laundry treating apparatus further comprises a ferromagnetic material disposed between the heater cover and the coil.

14. The laundry treating apparatus of claim 1, wherein the induction heater is configured to operate in a state in which the drum rotates relative to the tub.

15. The laundry treating apparatus of claim 14, wherein the induction heater is configured to initiate induction of the eddy current in a state in which the drum rotates relative to the tub.

16. The laundry treating apparatus of claim 12, wherein the coil defines a single layer with the wire, the single layer is spaced apart from an outer surface of the drum by a predetermined distance.

17. The laundry treating apparatus of claim 1, wherein the drum is spaced apart from the tub, the tub and the drum defining:

a first air flow path disposed between the rear wall portion of the drum and a rear surface of the tub and configured to guide air in a downward direction from the outlet of the duct; and a second air flow path disposed between a circumferential surface of the drum and a circumferential surface of the tub and configured to guide air from the first air flow path toward the front surface of the drum.

18. The laundry treating apparatus of claim 2, wherein the lint filter is disposed vertically between a circumferential surface of the drum and a circumferential surface of the tub, and wherein the heat exchanger is disposed vertically above the lint filter.

19. The laundry treating apparatus of claim 2, wherein the lint filter and at least a portion of the heat exchanger are disposed in the duct between the inlet of the duct and the outlet of the duct.

20. The laundry treating apparatus of claim 2, wherein the heat exchanger extends toward the rear wall portion of the drum and is inclined downward with respect to an upper surface of the tub.

* * * * *